US008709234B2

(12) United States Patent
Dandeu et al.

(10) Patent No.: US 8,709,234 B2
(45) Date of Patent: Apr. 29, 2014

(54) PROCESS FOR PRODUCING MIDDLE DISTILLATES BY HYDROISMERIZING AND HYDROCRACKING A HEAVY FRACTION FROM A FISCHER-TROPSCH EFFLUENT

(75) Inventors: Aurelie Dandeu, Saint-Just Chaleyssin (FR); Nathalie Marchal-George, Saint Genis Laval (FR); Vincent Coupard, Valencin (FR); Eric Caprani, Paris (FR); Jean Cosyns, Maule (FR); Damien Douziech, Rueil Malmaison (FR); Stephane Fedou, Paris (FR)

(73) Assignees: IFP Energies Nouvelles, Reuil-Malmaison Cedex (FR); ENI S.p.A., Rome (IT)

( * ) Notice: Subject to any disclaimer, the term of this patent is extended or adjusted under 35 U.S.C. 154(b) by 929 days.

(21) Appl. No.: 12/664,187

(22) PCT Filed: Jun. 3, 2008

(86) PCT No.: PCT/FR2008/000753

§ 371 (c)(1), (2), (4) Date: Aug. 2, 2010

(87) PCT Pub. No.: WO2009/004179

PCT Pub. Date: Jan. 8, 2009

(65) Prior Publication Data

US 2010/0298451 A1 Nov. 25, 2010

(30) Foreign Application Priority Data

Jun. 12, 2007 (FR) ..... 07 04224

(51) Int. Cl.

| | |
|---|---|
| ***C10G 65/10*** | (2006.01) |
| ***C10G 47/14*** | (2006.01) |
| ***C10G 49/22*** | (2006.01) |

(52) U.S. Cl.

USPC ..... 208/110; 208/59; 208/92; 208/100

(58) Field of Classification Search

USPC ..... 208/59, 92, 100, 110

See application file for complete search history.

(56) References Cited

U.S. PATENT DOCUMENTS

| | | | | |
|---|---|---|---|---|
| 3,726,788 | A | 4/1973 | Trythall | |
| 5,057,635 | A * | 10/1991 | Gajda | 585/259 |
| 2002/0169219 | A1 | 11/2002 | Moore, Jr. et al. | |
| 2003/0057133 | A1 * | 3/2003 | Benazzi et al. | 208/49 |
| 2005/0222481 | A1 * | 10/2005 | Johnson | 585/820 |

FOREIGN PATENT DOCUMENTS

| | | | |
|---|---|---|---|
| EP | 0 583 836 | A1 | 2/1994 |
| GB | 1 430 973 | A | 4/1976 |
| WO | WO 03/004584 | A1 | 1/2003 |
| WO | WO 2005/037960 | A1 | 4/2005 |

OTHER PUBLICATIONS

International Search Report of PCT/FR2008/000753 (Dec. 11, 2008).

* cited by examiner

*Primary Examiner* — Randy Boyer

(74) *Attorney, Agent, or Firm* — Millen, White, Zelano & Branigan, P.C.

(57) ABSTRACT

A process in which the paraffinic effluent derived from a Fischer-Tropsch synthesis unit is separated to obtain a heavy C5+ fraction, said heavy fraction then being hydrogenated in the presence of a hydrogenation catalyst at a temperature in the range 80° C to 200° C, at a total pressure in the range 0.5 to 6 MPa, at an hourly space velocity in the range 1 to 10 $h^{-1}$, and at a hydrogen flow rate corresponding to a hydrogen/hydrocarbons volume ratio in the range 5 to 80 NI/I/h, the liquid hydrogenated effluent then being brought into contact with a hydroisomerization/hydrocracking catalyst, with no prior separation step, the hydroisomerized/hydrocracked effluent then being distilled to obtain middle distillates and possibly oil bases.

16 Claims, 3 Drawing Sheets

PROCESS FOR PRODUCING MIDDLE DISTILLATES BY HYDROISMERIZING AND HYDROCRACKING A HEAVY FRACTION FROM A FISCHER-TROPSCH EFFLUENT

The present invention relates to a process for the treatment, using hydrocracking and hydroisomerization, of feeds from the Fischer-Tropsch process, to produce middle distillates (gas oil, kerosene), i.e. cuts with an initial boiling point of at least 150° C. and an end point of at most 340° C., and possibly oil bases.

In the Fischer-Tropsch process, synthesis gas ($CO+H_2$) is catalytically transformed into oxygen-containing products and essentially straight-chain hydrocarbons in the gas, liquid or solid form. However, such products, principally constituted by normal paraffins, cannot be used as they are, in particular because of their cold properties which are largely incompatible with the usual use of oil cuts. As an example, the pour point of a straight-chain hydrocarbon containing 20 carbon atoms per molecule (boiling point of about 340° C., i.e. usually in the middle distillates cut range) is about +37° C., rendering its use impossible, as the specification is −15° C. for gas oil. Hence, hydrocarbons from the Fischer-Tropsch process comprising mainly n-paraffins have to be transformed into products which are more upgradable, such as gas oil or kerosene which are, for example, obtained after catalytic hydroisomerization reactions.

Such products are generally free of heteroatomic impurities such as sulphur, nitrogen or metals. They contain almost no aromatics, naphthenes and more generally cyclic compounds, in particular in the case of cobalt catalysts.

In contrast, they may contain a non negligible quantity of unsaturated olefinic type compounds and oxygen-containing compounds (such as alcohols, carboxylic acids, ketones, aldehydes and esters). Such oxygen-containing and unsaturated compounds are, moreover, concentrated in the light fractions. Thus, in the C5+ fraction corresponding to products boiling at an initial boiling point in the range 20° C. to 40° C., such compounds represent 10-20% by weight of unsaturated olefinic type compounds and between 5-10% by weight of oxygen-containing compounds.

One of the aims of the invention is to eliminate unsaturated olefinic type compounds during a hydrotreatment step upstream of a hydrocracking step, said hydrotreatment step being carried out under less severe conditions than those of the hydrocracking step. The unsaturated olefinic type compounds present in the hydrocracking feeds reduce the service life of a hydrocracking catalyst. Under the severe hydrocracking/hydroisomerization operating conditions, since the hydrogenation of unsaturated olefinic type compounds is a highly exothermic reaction, the transformation of unsaturated compounds may have a negative impact on the hydroisomerization/hydrocracking step and, for example, cause reaction runaway, severe coking of the catalyst or the formation of gum by oligomerization.

One of the advantages of the invention is to provide a process for producing middle distillates from a paraffinic feed produced by Fischer-Tropsch synthesis in which the hydrocracking step is preceded by a hydrogenation step which can eliminate, initially and under conditions which are less severe than those employed in the hydrocracking step, the most reactive elements, in particular unsaturated olefinic type compounds.

PRIOR ART

Shell's patent (EP-A-0 583 836) describes a process for producing middle distillates from a feed obtained by the Fischer-Tropsch process. In this process, the feed from the Fischer-Tropsch synthesis may be treated in its entirety, but preferably the C4− fraction is removed from the feed so that only the C5+ fraction boiling at a temperature of over 20° C. is introduced into the subsequent step. Said feed undergoes hydrotreatment to hydrogenate the olefins and alcohols in the presence of a large excess of hydrogen, so that the conversion of products boiling above 370° C. into products with a lower boiling point is less than 20%. The hydrotreatmented effluent constituted by paraffinic hydrocarbons with a high molecular weight is preferably separated from the hydrocarbon compounds with a low molecular weight, in particular The C4− fraction before the second hydroconversion step. At least a portion of the remaining C5+ fraction then undergoes a hydrocracking/hydroisomerization step with less than 40% by weight conversion of products boiling above 370° C. into products with a lower boiling point.

The present invention proposes an alternative process for the production of middle distillates. The present invention has the following advantages:

- it protects the hydroisomerization/hydrocracking catalyst from the most reactive elements such as unsaturated olefinic type compounds by carrying out, upstream of the hydroisomerization/hydrocracking step, a step for hydrogenating unsaturated compounds, elimination of the unsaturated olefinic type compounds before the hydroisomerization/hydrocracking step avoiding the formation of coke or gum in the hydroisomerization/hydrocracking zone;
- it facilitates control of the temperature profile inside the hydroisomerization/hydrocracking zone by carrying out a step for hydrogenating unsaturated compounds, upstream of the hydroisomerization/hydrocracking step. Hydrogenation of the unsaturated olefinic type compounds is in fact a highly exothermic reaction which may have a negative impact on the hydroisomerization/hydrocracking step and, for example, cause thermal runaway of the reaction in the case in which such unsaturated compounds are not eliminated upstream of the hydroisomerization/hydrocracking step;
- it carries out a simplified process in which the quantity of hydrogen introduced into the hydrogenation zone corresponds to a quantity of hydrogen which is in slight excess with respect to the quantity which is strictly necessary to carry out the hydrogenation of unsaturated olefinic type compounds so that the process does not require installation of a recycle compressor and cracking is not carried out in the hydrogenation zone. This allows all of the liquid hydrogenated effluent to be sent directly, preferably by pumping, without an intermediate separation step, to the hydroisomerization/hydrocracking zone, as well as allowing a considerably reduced quantity of hydrogen to be used;
- it greatly improves the cold properties of paraffins from the Fischer-Tropsch process and produces boiling points which correspond to those of gas oil and kerosene fractions (also termed middle distillates) and in particular, it can improve the freezing point of kerosenes;
- it improves the quantity of middle distillates available by hydrocracking the heaviest paraffinic compounds present in the effluent from the outlet from the Fischer-Tropsch unit, and which have boiling points which are higher than those from kerosene and gas oil cuts, for example the 370° C.+ fraction.

FIG. 1 represents the broadest implementation of the process of the invention.

More precisely, FIG. 1 represents a process for producing middle distillates from a paraffinic feed produced by the Fischer-Tropsch synthesis, comprising the following steps in succession:

a) separating at least one gaseous C4− fraction, termed the light fraction, with an end point of less than 20° C., from the effluent from the Fischer-Tropsch synthesis unit to obtain a single liquid C5+ fraction termed the heavy fraction, with an initial boiling point in the range 20° C. to 40° C.;

b) hydrogenating the unsaturated olefinic type compounds of at least a portion of said heavy fraction C5+, in the presence of hydrogen and a hydrogenation catalyst at a temperature in the range 100° C. to 180° C., at a total pressure in the range 0.5 to 6 MPa, at an hourly space velocity in the range 1 to 10 $h^{-1}$, and at a hydrogen flow rate corresponding to a hydrogen/hydrocarbons volume ratio in the range 5 to 80 Nl/l/h;

c) hydroisomerizing/hydrocracking the entire liquid hydrogenated effluent from step b) with no prior separation step in the presence of hydrogen and a hydroisomerization/hydrocracking catalyst;

d) distilling the hydrocracked/hydroisomerized effluent.

DETAILED DESCRIPTION OF THE INVENTION

Throughout the remainder of the description, we shall detail the various steps of the process of the invention by referring to FIGS. 2 and 3 which represent preferred implementations of the process of the invention, without in any way limiting its scope.

Step a)

Step a) of the invention, not shown in FIG. 1, is a step for separating at least one C4− fraction, termed the light fraction, with an end point of less than 20° C., preferably less than 10° C. and more preferably less than 0° C., from the effluent derived from the Fischer-Tropsch synthesis to obtain a single C5+ fraction, termed the heavy fraction, with an initial boiling point in the range 20° C. to 40° C. and preferably with a boiling point of 30° C. or more, constituting at least a portion of the feed for hydrogenation step b) of the invention.

At the outlet from the Fischer-Tropsch synthesis, the effluent from the Fischer-Tropsch synthesis unit is, advantageously divided into two fractions, a light fraction termed the cold condensate (line 1) and a heavy fraction, termed the waxes (line 3).

Said two fractions as defined comprise water, carbon dioxide ($CO_2$), carbon monoxide (CO) and unreacted hydrogen ($H_2$). Further, the light fraction, the cold condensate, contains light C1 to C4 hydrocarbons, termed the C4− fraction, in gaseous form.

In accordance with a preferred implementation shown in FIG. 2, the light fraction, termed the cold condensate 1, and the heavy fraction, termed the waxes 3, are treated separately in separate fractionation means then recombined in line 5 to obtain a single C5+ fraction, termed the heavy fraction, with an initial boiling point in the range 20° C. to 40° C. and preferably with a boiling point of 30° C. or more. The heavy fraction, the waxes, enters a fractionation means 4 via a line 3. The fractionation means 4 may, for example, be constituted by means which are well known to the skilled person such as a flash drum, distillation or stripping. Advantageously, a flash drum or stripper is sufficient to eliminate from the heavy fraction, termed waxes, the major portion of the water, carbon dioxide ($CO_2$) and carbon monoxide (CO) via the line (4').

The light fraction, termed the cold condensate, enters a fractionation means 2 via the line 1. The fractionation means 2 may, for example, be constituted by means which are well known to the skilled person such as a flash drum, distillation or stripping. Advantageously, the fractionation means 2 is a distillation column which can eliminate light and gaseous C1 to C4 hydrocarbon compounds, termed the C4− gas fraction, corresponding to products boiling at a temperature of less than 20° C., preferably less than 10° C. and highly preferably less than 0° C., via the line 2'.

The stabilized effluents from the fractionation means 2 and 4 are then recombined in the line 5. A stabilized liquid C5+ fraction corresponding to products boiling at an initial boiling point in the range 20° C. to 40° C. and preferably with a boiling point of 30° C. or more is then recovered in the line 5 and constitutes the feed for hydrogenation step b) of the process of the invention.

In another preferred implementation represented in FIG. 3, the light fraction, termed the cold condensate, leaving the Fischer-Tropsch synthesis unit via the line 1 and the heavy fraction, termed the waxes, leaving the Fischer-Tropsch synthesis unit via the line 3 are recombined in the line 18 and treated in the same fractionation means 4. The fractionation means 4 may, for example, be constituted by means which are well known to the skilled person such as a flash drum, distillation or stripping. Advantageously, the fractionation means 4 is a distillation column which can eliminate the C4− gaseous fraction, water, carbon dioxide ($CO_2$) and carbon monoxide (CO) via the line 4'.

A stabilized C5+ liquid fraction corresponding to products boiling at a boiling point in the range 20° C. to 40° C. and preferably with a boiling point of 30° C. or more is then recovered from the outlet from the fractionation means 4 into line 5 and constitutes the feed for hydrogenation step b) of the process of the invention.

Step b)

Step b) of the process of the invention is a step for hydrogenating unsaturated olefinic type compounds of at least part and preferably the whole of the C5+ liquid heavy fraction from step a) of the process of the invention, in the presence of hydrogen and a hydrogenation catalyst.

Said C5+ liquid heavy fraction is admitted in the presence of hydrogen (line 6) into a hydrogenation zone 7 containing a hydrogenation catalyst which is intended to saturate the unsaturated olefinic type compounds present in the C5+ liquid heavy fraction described above.

Preferably, the catalyst used in step b) of the invention is a non-cracking or slightly cracking hydrogenation catalyst comprising at least one metal from group VIII of the periodic table of the elements and comprising at least one support based on a refractory oxide.

Preferably, said catalyst comprises at least one group VIII metal selected from nickel, molybdenum, tungsten, cobalt, ruthenium, indium, palladium and platinum and comprising at least one support based on a refractory oxide selected from alumina and silica-alumina.

Preferably, the group VIII metal is selected from nickel, palladium and platinum.

In accordance with a preferred implementation of step b) of the process of the invention, the group VIII metal is selected from palladium and/or platinum and the amount of said metal is advantageously in the range 0.1% to 5% by weight, preferably in the range 0.2% to 0.6% by weight with respect to the total weight of catalyst.

In accordance with a highly preferred implementation of step b) of the process of the invention, the group VIII metal is palladium.

In accordance with another preferred implementation of step b) of the process of the invention, the group VIII metal is nickel and the amount of this metal is advantageously in the range 5% to 25% by weight, preferably in the range 7% to 20% by weight with respect to the total weight of the catalyst.

The support for the catalyst used in step b) of the process of the invention is a support based on a refractory oxide, preferably selected from alumina and silica-alumina.

When the support is an alumina, it has a BET specific surface area which can limit polymerization reactions at the surface of the hydrogenation catalyst, said surface area being in the range 5 to 140 $m^2/g$.

When the support is a silica-alumina, the support contains a percentage of silica in the range 5% to 95% by weight, preferably in the range 10% to 80% by weight, more preferably in the range 20% to 60% and highly preferably in the range 30% to 50%, a BET specific surface area in the range 100 to 550 $m^2/g$, preferably in the range 150 to 500 $m^2/g$, more preferably less than 350 $m^2/g$ and still more preferably less than 250 $m^2/g$.

Hydrogenation step b) of the process of the invention is preferably carried out in one or more fixed bed reactors.

In the hydrogenation zone 7, the feed is brought into contact with the hydrogenation catalyst in the presence of hydrogen at operating temperatures and pressures which allow hydrogenation of the unsaturated olefinic type compounds present in the feed. Under these operating conditions, the oxygen-containing compounds are not converted, the liquid effluent hydrogenated from step b) of the process of the invention thus contains no water derived from the transformation of said oxygen-containing compounds.

According to the invention, the operating conditions of hydrogenation step b) are selected such that the effluent at the outlet from said hydrogenation zone 7 is in the liquid state; in fact, the quantity of hydrogen introduced into the hydrogenation zone 7 corresponds to a quantity of hydrogen which is in slight excess with respect to the quantity of hydrogen which is strictly necessary for carrying out the reaction for hydrogenation of the unsaturated olefinic type compounds. Thus, cracking is not carried out in the hydrogenation zone 7 and the liquid hydrogenated effluent does not contain hydrocarbon compounds boiling at a temperature of less than 20° C., preferably less than 10° C. and more preferably less than 0° C., corresponding to the C4– gaseous fraction.

The operating conditions for hydrogenation step b) of the process of the invention are as follows: the temperature in said hydrogenation zone 7 is in the range 100° C. to 180° C. and preferably in the range 120° C. to 165° C.; the total pressure is in the range 0.5 to 6 MPa, preferably in the range 1 to 5 MPa and more preferably in the range 2 to 5 MPa. The flow rate of the feed is such that the hourly space velocity (ratio of the hourly flow rate at 15° C. of fresh liquid feed to the volume of charged catalyst) is in the range 1 to 10 $h^{-1}$, preferably in the range 1 to 5 $h^{-1}$ and more preferably in the range 1 to 4 $h^{-1}$. The hydrogen which supplies the hydrotreatment zone is introduced at a flow rate such that the hydrogen/hydrocarbons volume ratio is in the range 5 to 80 Nl/l/h, preferably in the range 5 to 60, more preferably in the range 10 to 50 Nl/l/h, and still more preferably in the range 15 to 35 Nl/l/h.

Under these conditions, the unsaturated olefinic type compounds are more than 50% hydrogenated, preferably more than 75%, and preferably more than 85%.

The hydrogenation step b) of the process of the invention is preferably carried out under conditions such that the conversion of products with boiling points of 370° C. or more into products with boiling points of less than 370° C. is zero. The hydrogenated effluent from step b) of the process of the invention thus does not contain compounds boiling at a temperature of less than 20° C., preferably less than 10° C. and highly preferably less than 0° C., corresponding to the gaseous fraction C4–.

In accordance with a preferred implementation of step b) of the process of the invention, a guard bed (not shown in the Figures) is used containing at least one guard bed catalyst upstream of the hydrogenation zone 7 to reduce the quantity of solid mineral particles and possibly to reduce the amount of metallic compounds which damage the hydrogenation catalysts. The guard bed may advantageously either be integrated into the hydrogenation zone 7 upstream of the hydrogenation catalyst bed or be placed in a separate zone upstream of the hydrogenation zone 7.

The treated fractions may optionally contain solid particles such as mineral solids. They may optionally contain metals contained in hydrocarbon structures such as organometallic compounds of varying solubilities. The term "fines" means fines resulting from physical or chemical attrition of the catalyst. They may be on the micron-scale or submicron-scale. These mineral particles thus contain active components of said catalysts; a non-limiting list thereof follows: alumina, silica, titanic, zirconia, cobalt oxide, iron oxide, tungsten, ruthenium oxide, etc. Said mineral solids may be in the form of a calcined mixed oxide, for example alumina-cobalt, alumina-iron, alumina-silica, alumina-zirconia, alumina-titania, alumina-silica-cobalt, alumina-zirconia-cobalt, etc.

They may also contain metals within hydrocarbon structures which may optionally contain oxygen or organometallic compounds of varying solubilities. More particularly, these compounds may be based on silicon. They may, for example, be anti-foaming agents used in the synthesis process. Further, the catalyst fines described above may have a silica content which is greater than that of the catalyst formulation, resulting from intimate interaction between the catalyst fines and the anti-foaming agents described above.

The catalysts in the guard beds used in accordance with the invention may advantageously have the shape of spheres or extrudates. However, it is advantageous for the catalyst to be in the shape of extrudates with a diameter in the range 0.5 to 5 mm, more particularly in the range 0.7 to 2.5 mm. The shapes are cylinders (which may or may not be hollow), twisted cylinders, multilobes (2, 3, 4 or 5 lobes, for example), or rings. The cylindrical shape is preferred, but any other shape may be used.

To accommodate the presence of contaminants and/or poisons in the feed, the guard bed catalysts may, in a further preferred implementation, have more particular geometrical forms to increase their void fraction. The void fraction of said catalysts is in the range 0.2 to 0.75. Their external diameter may be between 1 and 35 mm. Possible particular non-limiting forms are: hollow cylinders, hollow rings, Raschig rings, toothed hollow cylinders, crenellated hollow cylinders, pentaring cartwheels, multiple holed cylinders, etc.

Preferably, said guard bed catalysts which are used are not impregnated with an active phase. The guard beds may be those sold by Norton-Saint-Gobain, for example MacroTrap® guard beds. The guard beds may be those sold by Axens from the ACT family: ACT077, ACT935, ACT961 or HMC841, HMC845, HMC941, HMC945 or HMC945. It may be particularly advantageous to superimpose these catalysts in at least two different beds of varying heights. The catalysts with the highest void ratio are preferably used in the first catalytic bed or beds at the inlet to the catalytic reactor. It may also be advantageous to use at least two different reactors for said catalysts. Said catalysts or guard beds used in accordance with the invention may advantageously exhibit macroporosity. In a preferred implementation, the macroporous volume for a mean diameter of 50 nm is more than 0.1 $cm^3/g$ with a total volume of more than 0.60 $cm^3/g$. In a further implementation, the mercury volume for a pore diameter of more than 1 micron is more than 0.5 $cm^3/g$ and the mercury volume for a pore diameter of more than 10 microns is more than 0.25 $cm^3/g$. These two implementations may advantageously be associated with a mixed or combined bed. Preferred guard beds of the invention are HMC and ACT961.

After passage over the guard bed, its solid particle content is advantageously less than 20 ppm, preferably less than 10 ppm and still more preferably less than 5 ppm. The quantity of soluble silicon is advantageously less than 5 ppm, preferably less than 2 ppm and more preferably less than 1 ppm.

At the end of step b) of the process of the invention, all of the liquid hydrogenated effluent is sent directly to a hydrocracking/hydroisomerization zone 10.

Step c)

In accordance with step c) of the process of the invention, all of the liquid hydrogenated effluent from step b) of the process of the invention is sent directly, with no prior separation step, to the hydroisomerization/hydrocracking zone 10 containing the hydroisomerization/hydrocracking catalyst, preferably at the same time as a stream of hydrogen (line 9).

The operating conditions in which hydroisomerization/hydrocracking step c) of the process of the invention is carried out are preferably as follows:

The pressure is generally kept between 0.2 and 15 MPa, preferably in the range 0.5 to 10 MPa and advantageously in the range 1 to 9 MPa; the space velocity is generally in the range 0.1 $h^{-1}$ to 10 $h^{-1}$, preferably in the range 0.2 to 7 $h^{-1}$ and advantageously in the range 0.5 to 5.0 $h^{-1}$. The hydrogen ratio is generally in the range 100 to 2000 normal litres of hydrogen per litre of feed per hour, preferably in the range 150 to 1500 litres of hydrogen per litre of feed.

The temperature used in this step is generally in the range 200 to 450° C. and preferably in the range 250° C. to 450° C., advantageously in the range 300 to 450° C., and more advantageously more than 320° C. or, for example, 320-420° C.

The hydroisomerization and hydrocracking step c) of the process of the invention is advantageously carried out under conditions such that the conversion per pass into products with a boiling point of 370° C. or more into products with boiling points of less than 370° C. is more than 80% by weight, and more preferably at least 85% and most preferably more than 88%, to obtain middle distillates (gas oil and kerosene) with sufficiently good cold properties (pour point, freezing point) to rigorously satisfy current specifications for this type of fuel.

The Hydroisomerization/hydrocracking Catalysts

The majority of the catalysts in current use in hydroisomerization are bi-functional in type, associating an acid function with a hydrogenating function. The acid function is supplied by supports with large surface areas (generally of 150 to 800 $m^2/g$) and with a superficial acidity, such as halogenated aluminas (in particular chlorinated or fluorinated), phosphorus-containing aluminas, combinations of oxides of boron and aluminium, and silica-aluminas. The hydrogenating function is generally supplied either by one or more metals from group VIII of the periodic table of the elements such as iron, cobalt, nickel, ruthenium, rhodium, palladium, osmium, iridium or platinum, or by a combination of at least one metal from group VI such as chromium, molybdenum or tungsten, and at least one group VIII metal.

In the case of bi-functional catalysts, the balance between the two functions, acid and hydrogenating, is the fundamental parameter which governs the activity and selectivity of the catalyst. A weak acid function and a strong hydrogenating function produces less active catalysts which are also less selective as regards isomerization, while a strong acid function and a weak hydrogenating function produces catalysts which are highly active and selective as regards cracking. A third possibility is to use a strong acid function and a strong hydrogenating function to obtain a catalyst which is highly active but also highly selective as regards isomerization. Thus, by carefully selecting each of the functions, it is possible to adjust the activity/selectivity balance of the catalyst.

Advantageously, the hydroisomerization/hydrocracking catalysts are bi-functional catalysts comprising an amorphous acid support (preferably a silica-alumina) and a metallic hydro-dehydrogenating function which is preferably provided by at least one noble metal. The support is termed amorphous, i.e. free of molecular sieve and in particular zeolite, as is the catalyst. The amorphous acid support is advantageously a silica-alumina, but other supports may be used. When it is a silica-alumina, the catalyst preferably contains no added halogen other than that which may be introduced for impregnation with the noble metal.

More generally and preferably, the catalyst contains no added halogen, for example fluorine. In general and preferably, the support has not undergone impregnation with a silicon compound.

A preferred hydroisomerization/hydrocracking catalyst used in step c) of the process of the invention comprises up to 3% by weight of metal of at least one hydro-dehydrogenating element selected from noble metals from group VIII, preferably deposited on the support; highly preferably, the noble group VIll metal is platinum, and a support comprising (or preferably constituted by) at least one silica-alumina, said silica-alumina having the following characteristics:

- a weight content of silica, $SiO_2$, in the range 5% to 95%, preferably in the range 10% to 80%, more preferably in the range 20% to 60% and still more preferably in the range 30% to 50% by weight;
- a Na content of less than 300 ppm by weight, preferably less than 200 ppm by weight;
- a total pore volume in the range 0.45 to 1.2 ml/g, measured by mercury porosimetry;
- the porosity of said silica-alumina being as follows:
  - i) the volume of mesopores with a diameter in the range 40 Å to 150 Å and with a mean diameter in the range 80 to 140 Å, preferably in the range 80 to 120 Å, represents 20-80% of the total pore volume measured by mercury porosimetry;
  - ii) the volume of micropores with a diameter of more than 500 Å, preferably in the range 1000 Å to 10000 Å, represents 20 to 80% of the total pore volume, by mercury porosimetry;
- a specific surface area in the range 100 to 500 $m^2/g$, preferably in the range 150 to 500 $m^2/g$, more preferably less than 350 $m^2/g$ and still more preferably less than 250 $m^2/g$.

A second preferred hydroisomerization/hydrocracking catalyst used in step c) of the process of the invention comprises up to 3% by weight of metal of at least one hydro-dehydrogenating element selected from noble metals from group VIII of the periodic table of the elements; preferably, the noble group VIII metal is platinum; 0.01% to 5.5% by weight of oxide of a doping element selected from phosphorus, boron and silicon and a non-zeolitic support based on silica-alumina containing a quantity of more than 15% by weight and 95% by weight or less of silica ($SiO_2$), said silica-alumina having the following characteristics:

- a mean pore diameter, measured by mercury porosimetry, in the range 20 to 140 Å;

a total pore volume, measured by mercury porosimetry, in the range 0.1 ml/g to 0.5 ml/g;

a total pore volume, measured by nitrogen porosimetry, in the range 0.1 ml/g to 0.6 ml/g;

a BET specific surface area in the range 100 to 550 $m^2/g$;

a pore volume, measured by mercury porosimetry, included in pores with a diameter of more than 140 Å, of less than 0.1 ml/g;

a pore volume, measured by mercury porosimetry, included in pores with a diameter of more than 160 Å, of less than 0.1 ml/g;

a pore volume, measured by mercury porosimetry, included in pores with a diameter of more than 200 Å, of less than 0.1 ml/g;

a pore volume, measured by mercury porosimetry, included in pores with a diameter of more than 500 Å, of less than 0.1 ml/g;

an X ray diffraction diagram which contains at least the principal characteristic peaks of at least one of the transition aluminas included in the group composed of alpha, rho, chi, eta, gamma, kappa, theta and delta aluminas;

a settled catalyst packing density of more than 0.55 $g/cm^3$.

Advantageously, the characteristics associated with the corresponding catalyst are identical to those of the silica-alumina described above.

The two steps b) and c) of the process of the invention, hydrogenation and hydroisomerization-hydrocracking, may advantageously be carried out on the two types of catalysts in two or more different reactors and/or in the same reactor.

A third preferred hydroisomerization/hydrocracking catalyst used in step c) of the process of the invention comprises at least one hydro-dehydrogenating element selected from non noble metals from group VIII and metals from group VIB of the periodic table of the elements, preferably between 2.5 and 5% by weight of oxide of the non noble element from group VIII and between 20 and 35% by weight of oxide of a group VIB element with respect to the weight of the final catalyst; preferably, the non noble group VIII metal is nickel and the group VIB metal is tungsten; optionally 0.01% to 5.5% by weight of oxide of a doping element selected from phosphorus, boron and silicon; preferably, 0.01 to 2.5% by weight of oxide of a doping element and a non-zeolitic support based on silica-alumina containing a quantity of more than 15% by weight and 95% by weight or less of silica ($SiO_2$), preferably a quantity of more than 15% by weight and 50% by weight or less of silica, said silica-alumina having the following characteristics:

a mean pore diameter, measured by mercury porosimetry, in the range 20 to 140 Å;

a total pore volume, measured by mercury porosimetry, in the range 0.1 ml/g to 0.5 ml/g;

a total pore volume, measured by nitrogen porosimetry, in the range 0.1 ml/g to 0.6 ml/g;

a BET specific surface area in the range 100 to 550 $m^2/g$;

a pore volume, measured by mercury porosimetry, included in pores with a diameter of more than 140 Å, of less than 0.1 ml/g;

a pore volume, measured by mercury porosimetry, included in pores with a diameter of more than 160 Å, of less than 0.1 ml/g;

a pore volume, measured by mercury porosimetry, included in pores with a diameter of more than 200 Å, of less than 0.1 ml/g;

a pore volume, measured by mercury porosimetry, included in pores with a diameter of more than 500 Å, of less than 0.1 ml/g;

an X ray diffraction diagram which contains at least the principal characteristic peaks of at least one of the transition aluminas included in the group composed of alpha, rho, chi, eta, gamma, kappa, theta and delta aluminas;

a settled catalyst packing density of more than 0.55 $g/cm^3$.

Advantageously, the characteristics associated with the corresponding catalyst are identical to those of the silica-alumina described above.

When the third preferred hydroisomerization/hydrocracking catalyst is used in step c) of the process of the invention, the catalyst is sulphurized.

In accordance with a first preferred implementation of the process of the invention, in hydrogenation step b), a catalyst is used which contains palladium and in hydroisomerization/hydrocracking step c), a catalyst containing platinum is used.

In accordance with a second preferred implementation of the process of the invention, in hydrogenation step b) a catalyst containing palladium is used and in hydroisomerization/hydrocracking step c), a sulphurized catalyst containing at least one hydro-dehydrogenating element selected from non noble metals from group VIII and group VIB metals is used.

In a third preferred implementation of the process of the invention, in hydrogenation step b) a catalyst containing at least one hydro-dehydrogenating element non noble from group VIII is used and in hydroisomerization/hydrocracking step c), a sulphurized catalyst is used containing at least one hydro-dehydrogenating element selected from non noble group VIII metals and group VIB metals is used.

Step d)

In accordance with step d) of the process of the invention, the effluent (the fraction termed hydrocracked/hydroisomerized) from the outlet from the hydroisomerization/hydrocracking zone 10 from step c) of the process of the invention is sent, to a distillation train 11 which combines atmospheric distillation and possibly vacuum distillation, which is intended to separate conversion products with a boiling point of less than 340° C. and preferably less than 370° C. and in particular including those formed during step c) in the hydroisomerization/hydrocracking reactor 10, and to separate the residual fraction with an initial boiling point which is generally more than at least 340° C. and preferably at least 370° C. or higher. Of the converted and hydroisomerized products, in addition to the light C1-C4 gases (line 14), at least one gasoline (or naphtha) fraction is separated (line 13), and at least one kerosene middle distillate fraction (line 14) and a gas oil fraction (line 15) are separated. Preferably, the residual fraction, with an initial boiling point which is generally over at least 340° C. and preferably at least 370° C. or more is recycled (line 16) to step c) of the process of the invention to the head of the hydroisomerization and hydrocracking zone 10. In accordance with another implementation of step d) of the process of the invention, said residual fraction may supply excellent oil bases.

It may also be advantageous to recycle (line 17) at least part and preferably all of at least one of the kerosene and gas oil cuts obtained to step c) (line 10). The gas oil and kerosene cuts are preferably recovered separately or mixed, but the cut points are adjusted by the operator as a function of requirements. It has been shown that it is advantageous to recycle part of the kerosene to improve its cold properties.

Products Obtained

The gas oil(s) obtained have a pour point of at most 0° C., generally less than −10° C. and usually less than −15° C. The ketane index is more than 60, generally more than 65, and usually more than 70.

The kerosene(s) obtained have a freezing point of at most −35° C., generally less than −40° C. The smoke point is more than 25 mm, generally more than 30 mm. In this process, gasoline (unwanted) production is as low as possible. The gasoline yield is always less than 50% by weight, preferably less than 40% by weight, advantageously less than 30% by weight or 20% by weight or even 15% by weight.

Figure 1:
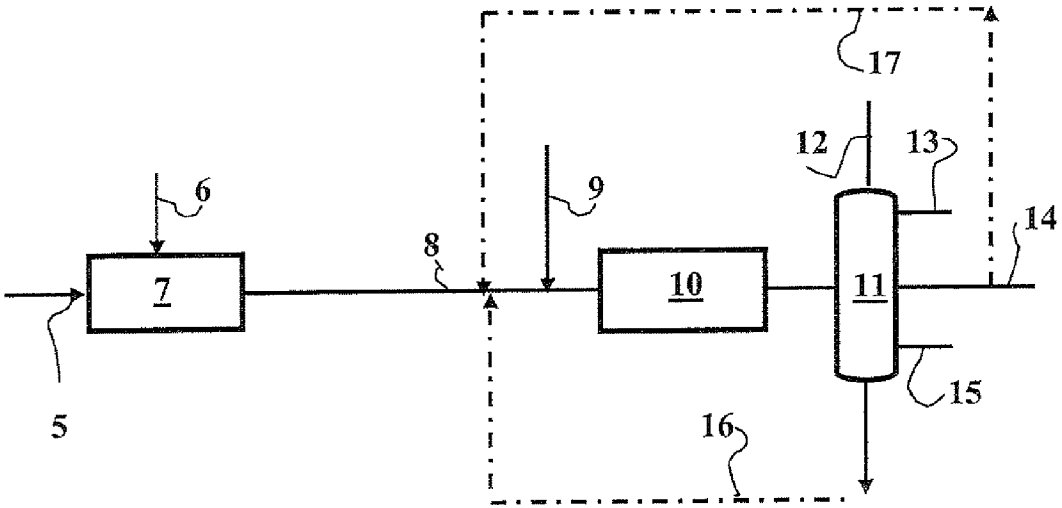
FIG. 1 illustrates a broad implementation of the process of the disclosure.
Figure 2:
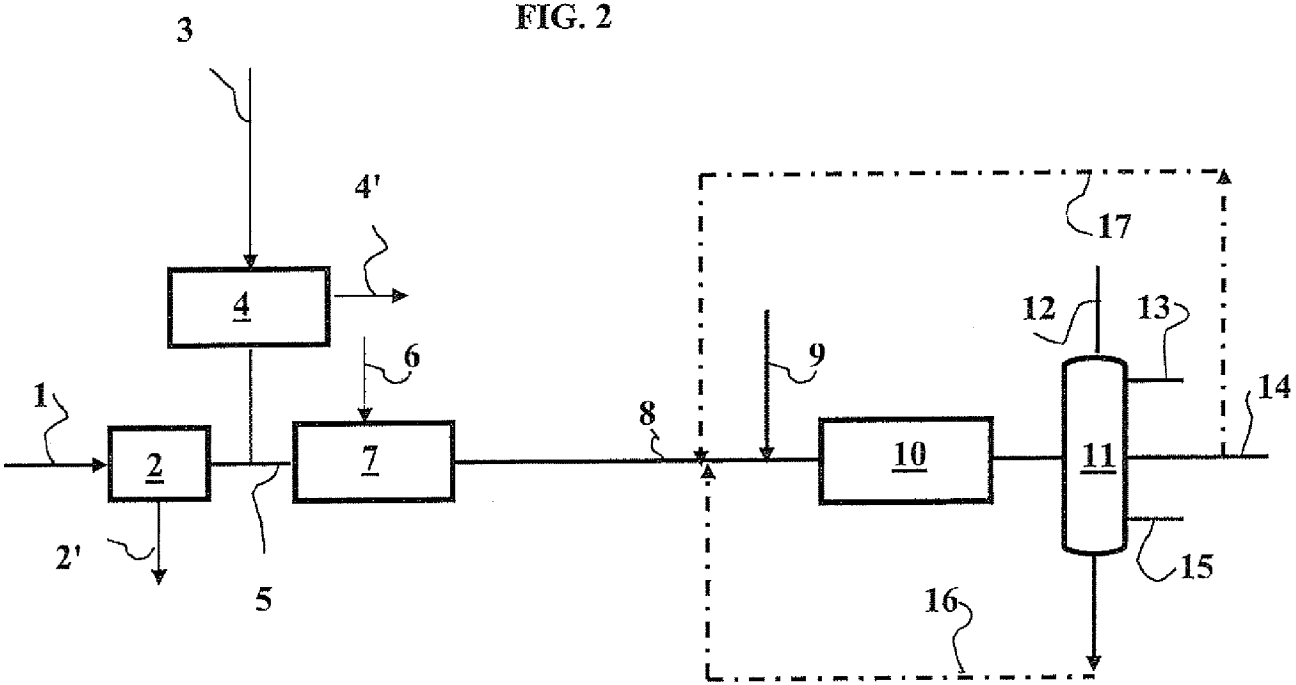
FIG. 2 illustrates a preferred implementation of the process of the disclosure.
Figure 3:
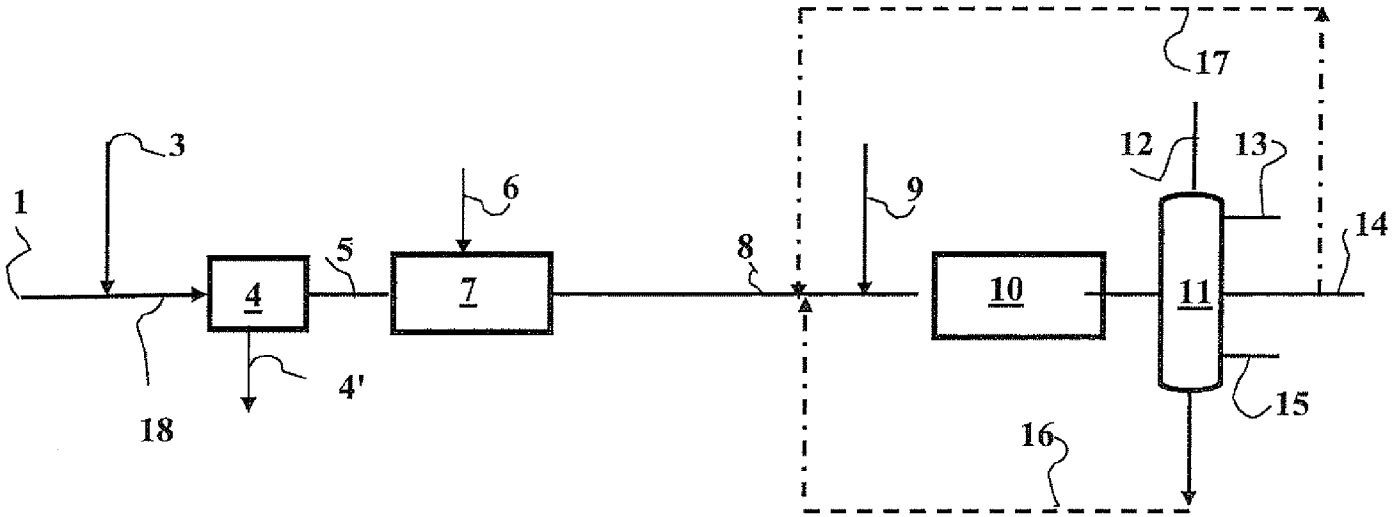
FIG. 3 illustrates another preferred implementation of the process of the disclosure.

The invention claimed is:

1. A process for producing middle distillates from a paraffinic feed produced by Fischer-Tropsch synthesis unit, comprising the following steps in succession:

a) separating at least one gaseous C4− fraction, termed the light fraction, with an end boiling point of less than 20° C., from an effluent derived from the Fischer-Tropsch synthesis unit to obtain a single C5+ liquid fraction, termed the heavy fraction, with an initial boiling point in the range of 20° C. to 40° C.;

b) hydrogenating the unsaturated olefinic type compounds of at least a portion of said heavy liquid fraction C5+, in the presence of hydrogen and a hydrogenation catalyst at a temperature in the range of 100° C. to 180° C., at a total pressure in the range of 0.5 to 6 MPa, at an hourly space velocity in the range of 1 to 10 $h^{-1}$, and at a hydrogen flow rate corresponding to a hydrogen/hydrocarbons volume ratio in the range of 5 to 80 Nl/l/h to obtain a liquid hydrogenated effluent;

c) hydroisomerizing/hydrocracking the entire liquid hydrogenated effluent from step b) with no prior separation step in the presence of hydrogen and a hydroisomerization/hydrocracking catalyst;

d) distilling resultant hydrocracked/hydroisomerized effluent from step (c)

and wherein said hydroisomerization/hydrocracking catalyst comprises up to 3% by weight of at least one hydrodehydrogenating element selected from noble metals from group VIII and a support comprising at least one silica-alumina, said silica-alumina having the following characteristics:

a weight content of silica $SiO_2$ in the range of 5% to 95%;

a Na content of less than 300 ppm by weight;

a total pore volume in the range of 0.45 to 1.2 ml/g, measured by mercury porosimetry;

said silica-alumina having a porosity as follows:

i) the volume of mesopores with a diameter in the range of 40 Å to 150 Å and with a mean diameter in the range of 80 to 140 Å represents 20-80% of the total pore volume measured by mercury porosimetry;

ii) the volume of macropores with a diameter of more than 500 Å, represents 20% to 80% of the total pore volume, by mercury porosimetry;

a specific surface area in the range of 100 to 550 $m^2/g$.

2. A process according to claim 1, in which, at an outlet from the Fischer-Tropsch synthesis unit, said effluent from the Fischer-Tropsch synthesis unit is divided into two fractions, a light fraction termed the cold condensate, and a heavy fraction termed the waxes.

3. A process according to claim 2, in which the light fraction, termed the cold condensate, and the heavy fraction, termed the waxes, are treated separately in separate fractionation means then re-combined, to obtain a single C5+ fraction, termed the heavy fraction, with an initial boiling point in the range of 20° C. to 40° C.

4. A process according to claim 2, in which the light fraction, termed the cold condensate and the heavy fraction, termed the waxes, are re-combined and subjected to fractionation.

5. A process according to claim 1, in which said hydrogenation catalyst comprises at least one metal from group VIII of the periodic table of the elements and comprises at least one support based on a refractory oxide.

6. A process according to claim 5, in which the group VIII metal is palladium.

7. A process according to claim 2 comprising subjecting to hydrogenation unsaturated olefinic type compounds from at least a portion of said heavy fraction at a hydrogen/hydrocarbons volume ratio in the range of 10 to 50 Nl/l/h.

8. A process according to claim 2, in which the hydrogenation of the unsaturated olefinic type compounds from at least a portion of said heavy fraction is carried out at a hydrogen/hydrocarbons volume ratio in the range 15 to 35 Nl/l/h.

9. A process according to claim 1, further comprising a guard bed containing at least one guard bed catalyst upstream of the hydrogenation zone, said guard bed being either integrated into the hydrogenation zone upstream of the hydrogenation catalyst bed or placed in a separate zone upstream of the hydrogenation zone.

10. A process according to claim 1, in which said hydroisomerization/hydrocracking step c) is carried out at a pressure in the range of 0.2 to 15 MPa, at a space velocity in the range of 0.1 $h^{-1}$ to 10 $h^{-1}$ and a hydrogen ratio in the range of 100 to 2000 normal liters of hydrogen per liter of feed per hour and at a temperature in the range of 200° C. to 450° C.

11. A process according to claim 1, in which a fraction from step (d) with a boiling point of more than 340° C. is recycled to step c).

12. A process according to claim 1, wherein the support consists of silica-alumina.

13. A process according to claim 1, wherein the diameter of said macropores is in the range of 1000 Å, to 10,000 Å.

14. A process for producing middle distillates from a paraffinic feed produced by Fischer-Tropsch synthesis unit, comprising the following steps in succession:

a) separating at least one gaseous C4− fraction, termed the light fraction, with an end boiling point of less than 20° C., from an effluent derived from the Fischer-Tropsch synthesis unit to obtain a single C5+ liquid fraction, termed the heavy fraction, with an initial boiling point in the range of 20° C. to 40° C.;

b) hydrogenating the unsaturated olefinic type compounds of at least a portion of said heavy liquid fraction C5+, in the presence of hydrogen and a hydrogenation catalyst at a temperature in the range of 100° C. to 180° C., at a total pressure in the range of 0.5 to 6 MPa, at an hourly space velocity in the range of 1 to 10 $h^{-1}$, and at a hydrogen flow rate corresponding to a hydrogen/hydrocarbons volume ratio in the range of 5 to 80 Nl/l/h to obtain a liquid hydrogenated effluent;

c) hydroisomerizing/hydrocracking the entire liquid hydrogenated effluent from step b) with no prior separation step in the presence of hydrogen and a hydroisomerization/hydrocracking catalyst;

d) distilling resultant hydrocracked/hydroisomerized effluent from step (c)

and wherein said hydroisomerization/hydrocracking catalyst comprises up to 3% by weight of metal of at least one hydro-dehydrogenating element selected from noble metals from group VIII of the periodic table of the elements, 0.01% to 5.5% by weight of oxide of a doping element selected from phosphorus, boron and silicon, and a non-zeolitic support based on silica-alumina containing a quantity of more than 15% by weight and 95% or less by weight of silica ($SiO_2$), said silica-alumina having the following characteristics:

a mean pore diameter, measured by mercury porosimetry, in the range of 20 to 140 Å;

a total pore volume, measured by mercury porosimetry, in the range of 0.1 ml/g to 0.5 ml/g;

a total pore volume, measured by nitrogen porosimetry, in the range of 0.1 ml/g to 0.6 ml/g;

a BET specific surface area in the range of 100 to 550 $m^2/g$;

a pore volume, measured by mercury porosimetry, included in pores with a diameter of more than 140 Å, of less than 0.1 ml/g;

a pore volume, measured by mercury porosimetry, included in pores with a diameter of more than 160 Å, of less than 0.1 ml/g;

a pore volume, measured by mercury porosimetry, included in pores with a diameter of more than 200 Å, of less than 0.1 ml/g;

a pore volume, measured by mercury porosimetry, included in pores with a diameter of more than 500 Å, of less than 0.1 ml/g;

an X ray diffraction diagram which contains at least the principal characteristic peaks of at least one transition alumina included in the group composed of alpha, rho, chi, eta, gamma, kappa, theta and delta aluminas;

a settled catalyst packing density of more than 0.55 $g/cm^3$.

15. A process for producing middle distillates from a paraffinic feed produced by Fischer-Tropsch synthesis unit, comprising the following steps in succession:

a) separating at least one gaseous C4− fraction, termed the light fraction, with an end boiling point of less than 20° C., from an effluent derived from the Fischer-Tropsch synthesis unit to obtain a single C5+ liquid fraction, termed the heavy fraction, with an initial boiling point in the range of 20° C. to 40° C.;

b) hydrogenating the unsaturated olefinic type compounds of at least a portion of said heavy liquid fraction C5+, in the presence of hydrogen and a hydrogenation catalyst at a temperature in the range of 100° C. to 180° C., at a total pressure in the range of 0.5 to 6 MPa, at an hourly space velocity in the range of 1 to 10 $h^{-1}$, and at a hydrogen flow rate corresponding to a hydrogen/hydrocarbons volume ratio in the range of 5 to 80 Nl/l/h to obtain a liquid hydrogenated effluent;

c) hydroisomerizing/hydrocracking the entire liquid hydrogenated effluent from step b) with no prior separation step in the presence of hydrogen and a hydroisomerization/hydrocracking catalyst;

d) distilling resultant hydrocracked/hydroisomerized effluent from step (c)

and wherein said hydroisomerization/hydrocracking catalyst comprises between 2.5% and 5% by weight of oxide of an element from group VIII and between 20% and 35% by weight of oxide of a group VIB element with respect to the weight of the final catalyst, optionally 0.01% to 5.5% by weight of oxide of a doping element selected from phosphorus, boron and a non-zeolitic support based on silica-alumina containing a quantity of more than 15% by weight and 95% by weight or less of silica ($SiO_2$), said silica-alumina having the following characteristics:

a mean pore diameter, measured by mercury porosimetry, in the range of 20 to 140 Å;

a total pore volume, measured by mercury porosimetry, in the range of 0.1 ml/g to 0.5 ml/g;

a total pore volume, measured by nitrogen porosimetry, in the range of 0.1 ml/g to 0.6 ml/g;

a BET specific surface area in the range of 100 to 550 $m^2/g$;

a pore volume, measured by mercury porosimetry, included in pores with a diameter of more than 140 Å, of less than 0.1 ml/g;

a pore volume, measured by mercury porosimetry, included in pores with a diameter of more than 160 Å, of less than 0.1 ml/g;

a pore volume, measured by mercury porosimetry, included in pores with a diameter of more than 200 Å, of less than 0.1 ml/g;

a pore volume, measured by mercury porosimetry, included in pores with a diameter of more than 500 Å, of less than 0.1 ml/g;

an X ray diffraction diagram which contains at least the principal characteristic peaks of at least one transition alumina included in the group composed of alpha, rho, chi, eta, gamma, kappa, theta and delta aluminas;

a settled catalyst packing density of more than 0.55 $g/cm^3$.

16. A process according to claim 15, in which said catalyst is sulphurized.

* * * * *

UNITED STATES PATENT AND TRADEMARK OFFICE

CERTIFICATE OF CORRECTION

PATENT NO. : 8,709,234 B2
APPLICATION NO. : 12/664187
DATED : April 29, 2014
INVENTOR(S) : Dandeu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1160 days.

Signed and Sealed this
Twenty-ninth Day of September, 2015

Michelle K. Lee

Michelle K. Lee
*Director of the United States Patent and Trademark Office*